United States Patent [19]

Smith et al.

[11] 4,240,324

[45] Dec. 23, 1980

[54] AUTOMATIC GUN

[75] Inventors: William G. Smith, Burns, Ind.; Ladd Yuhash, Budd Lake, N.J.

[73] Assignee: The United States of America as represented by the Secretary of the Army, Washington, D.C.

[21] Appl. No.: 955,811

[22] Filed: Oct. 30, 1978

[51] Int. Cl.[3] ..... F41D 5/02

[52] U.S. Cl. ..... 89/156; 89/167; 89/198; 89/132

[58] Field of Search ..... 42/15, 23, 24, 39.5; 89/4 B, 24, 33 ML, 155, 156, 167, 186

[56] References Cited

U.S. PATENT DOCUMENTS 30,760 11/1860 Reeder ..... 42/15

3,355,988 12/1967 D'Andrea ..... 89/24

3,866,513 2/1975 Horneck et al. ..... 89/4 B

*Primary Examiner*—Stephen C. Bentley

*Attorney, Agent, or Firm*—Nathan Edelberg; Robert P. Gibson; A. Victor Erkkila

[57] ABSTRACT

An automatic gun for firing a projectile by means of a separately loaded propellant case has a receiving frame in which an elongated barrel can reciprocate. The barrel, which has an axial bore from its breech to its muzzle, has a chamber member slidably mounted on its breech end. This chamber member, having a concavity shaped to hold the propellant case, is transversely displaced from alignment with the barrel to an unlocked position by an actuating means, in response to barrel recoil.

9 Claims, 7 Drawing Figures

AUTOMATIC GUN

GOVERNMENTAL INTEREST

The invention described herein may be manufactured, used and licensed by or for the Government for Governmental purposes without the payment to use of any royalties thereon.

BACKGROUND OF THE INVENTION

The present invention relates to automatic guns and in particular to guns separately loadable with a projectile and a propellant case.

Conventional automatic guns have used the energy developed by their recoil to automatically eject and reload ammunition. In a known automatic gun, a breech block is removable from a breech position contiguous to a propellant case. After firing, the breech block is removed and an extractor arm is employed to automatically remove and eject the spent propellant case from the bore of the gun barrel. In this known arrangement the recoil motion of the barrel itself is not used to insert the ammunition. In addition, since a combined projectile and propellant case are employed, the internal moving parts must be capable of translating the ammunition a distance equivalent to its entire combined length (The Machine Gun (1955), George M. Chinn, Bureau of Ordnance, Dept. of the Navy, Vol. III, Parts VIII and IX, Pages 265–286 and Pages 351–380; and Vol. IV, Parts X and XI, Chapter 2, Pages 63–125). In another known automatic gun a breech block is mounted on the aft of a movable chamber. This movable chamber is articulated from a common frame which also supports the gun barrel. Being so mounted this movable chamber cannot use the recoil motion of the gun barrel to insert ammunition. Moreover, being arranged to accept ammunition comprising a projectile integrally mounted on a propellant case, the movable chamber must be as long as the combined length of this type of ammunition. Also, since ammunition is inserted into the aft of the movable chamber after its breech block is displaced, a relatively complicated linkage must be provided to simultaneously translate the movable chamber and displace its breech block.

The present invention provides an automatic gun which allows the recoil motion of the barrel to simultaneously open its breech end and ensheath a projectile. Opening the breech end in this manner is accomplished by displacing an aft chamber which is otherwise aligned with the barrel. Opening the barrel also opens the chamber member which can then ensheath a propellant casing during a counter-recoil stroke. When the gun is ultimately returned to its battery position, the barrel has been reloaded with a projectile. The aft chamber has also been reloaded with a propellant case and locked onto the barrel. Such an arrangement therefore provides rapid automatic loading of ammunition. Such loading occurs during recoil and counter-recoil strokes which need only be one-half of the combined length of the projectile and its associated propellant case.

SUMMARY OF THE INVENTION

In accordance with the illustrative embodiments demonstrating features and advantages of the present invention, there is provided an automatic gun for firing a projectile by means of a separately loaded propellant case. The gun includes a receiving frame and an elongated barrel. The elongated barrel has a breech end transpierced by an axial bore. The barrel is mounted in the frame for reciprocation therein. Also included is a resilient means for forwardly urging the barrel to a battery position. The gun also includes a chamber member having a concavity shaped to hold the propellant case. The chamber member is slidably mounted on the breech end of the barrel. The chamber member is transversely displaceable from alignment with the axial bore to an unlocked position at which the concavity is accessible. The receiving frame also includes an actuating means. This actuating means transversely displaces the chamber member from alignment with the axial bore to the unlocked position in response to the barrel recoiling.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENT

Figure 1:
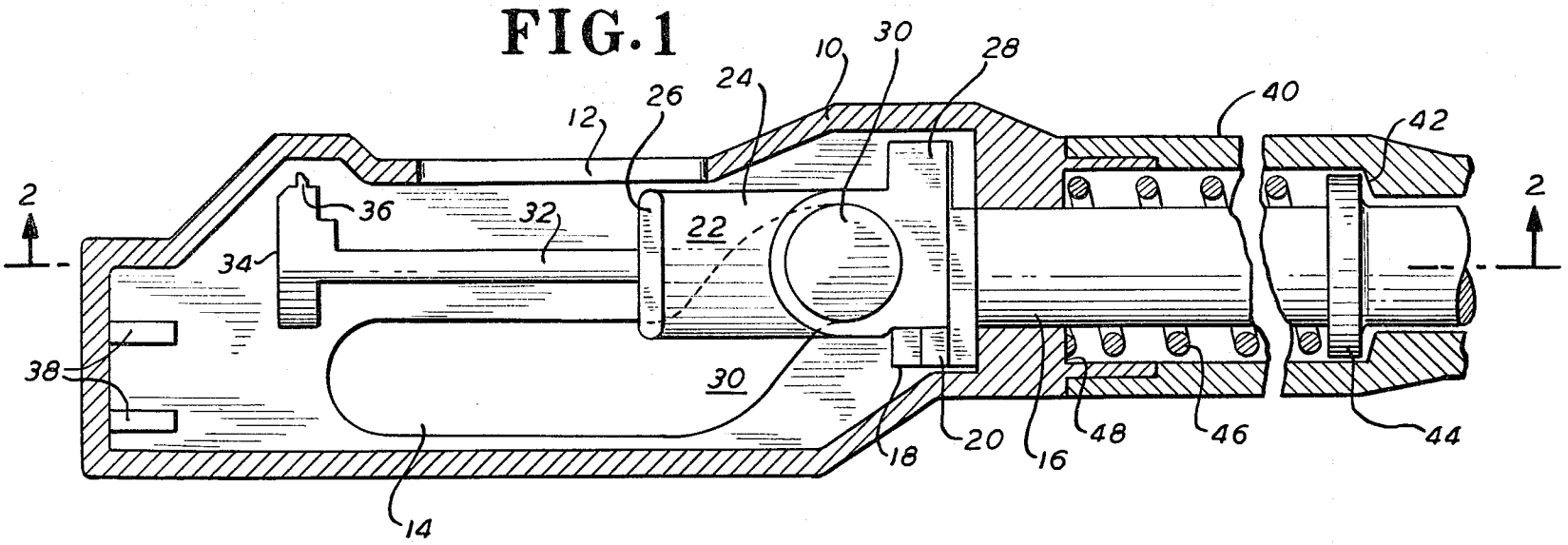
FIG. 1 is a plan view, partly in section, of an automatic gun of the instant invention.

Referring now specifically to the drawings, in FIG. 1 there is shown an automatic gun having a receiving frame 10 which is shown centrally sectioned. Frame 10 is symmetrical about its plane of section. Frame 10 has transpiercing its left and bottom face, projectile port 12 and propellant port 14, respectively, the latter being shown as a nonlinear track. Since it is symmetrical, frame 10 has another propellant port (shown hereinafter) on an opposite wall opposing port 14. While frame 10 comprises a box-like structure, it is apparent that it may be shaped differently in other embodiments. An elongated barrel 16, shown slidably mounted on frame 10, has an axial bore (illustrated hereinafter) which runs its entire length. Barrel 16 has at its breech end an integral rectangular block 18 which has a groove 20 formed therein. As more clearly illustrated hereinafter, a groove opposing groove 20 is formed on the opposite side of block 18. Slidably mounted upon groove 20 is chamber member 22, shown herein as comprising a cylindrical midsection 24, a rear rectangular portion 26, a forward rectangular portion 28 and a follower 30. Follower 30 is shown as a transverse projection from a planar surface contiguous to rectangular portion 28. While a relatively complex shape is shown for chamber member 22, it is apparent that it may instead be formed of a simple cup shaped or bell shaped member having tangential grooves on its forward end which interlock with a tongue on the breech end of a barrel.

Projecting from a side opposite that of follower 30 is another follower (shown hereinafter). Both follower 30 and its opposing follower engage nonlinear symmetrical slots on opposing walls of frame 10, port 14 being one such slot. It will be observed that slot 14 has a relatively long rearward track which is parallel to the axis of barrel 16. Slot 14 also has a relatively short forward track which is also parallel to the axis to barrel 16. Between these two parallel tracks there is a transition section 30. Slot 14 and its opposing slot are an example of an actuating means for unlocking chamber member 22 during recoil. It is apparent, however, that many other mechanical, electromechanical or pneumatic devices can be employed to unlock chamber member 22 instead.

Slidably mounted into a rear coaxial aperture in chamber member 22 is ejector rod 32. Rod 32 is arranged to telescope into chamber member 22 under conditions described hereinafter. Mounted on the aft end of rod 32 is a resilient section 34 e.g. a coil spring which is employed to absorb shock in a manner described subsequently. Also attached to this aft end is trigger means 36 which is arranged to provide a triggering shock along rod 32 to ignite propellants which may be contained in chamber member 22. The details of such triggering mechanisms are well known in the art and therefore need not be described specifically. A pair of buffer means 38 are shown projecting inwardly from the rear wall of receiving frame 10.

Force fitted over the forward end of receiving frame 10 is cylindrical housing 40 having concentric inwardly projecting shoulders 42. Shoulders 42 abut and limit the forward motion of flange 44 of barrel 16. Forwardly urging barrel 16 is a resilient means shown herein as coil spring 46, which is entrapped between flange 44 and the forward face 48 of receiving frame 10. In this figure flange 44 of barrel 16 has been urged forward into abutment with shoulder 42, this position being referred to herein as a battery position. As will become clear from subsequent description, barrel 16 has an axial bore which is aligned with the concavity (shown hereinafter) of chamber member 22. This alignment is ensured by the cooperation between slot 14, its associated follower, follower 30 and its associated slots (illustrated subsequently).

Figure 2:
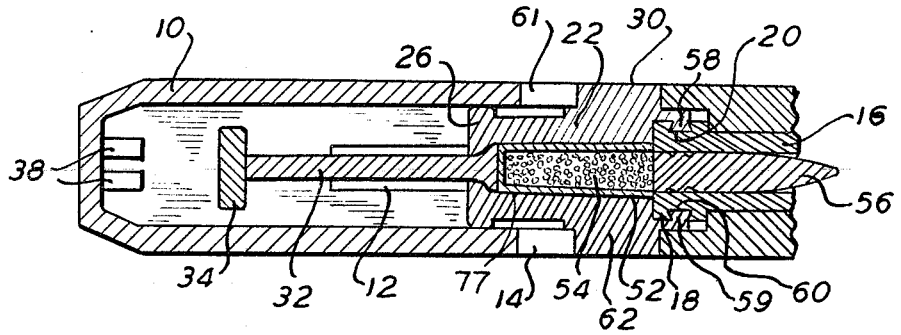
FIG. 2 is an elevational view in section along lines 2—2 of FIG. 1.

Referring to FIG. 2, a right side view along the lines 2—2 of FIG. 1 shows chamber member 22 having propellant case 52 inserted into a concavity or bore 77 in chamber member 22. This concavity is essentially cylindrical but with a coaxial aperture in its rear face into which ejector rod 32 is slidably mounted. Propellant case 52 is shown filled with explosive charge 54. Loaded into the breech end of barrel 16 is projectile 56, it aft end being coplanar with the rear face of block 18. Also shown is the inwardly projecting tongue 58 of chamber member 22. Tongues 58 and 59 engage and are locked into grooves 20 and 60, respectively. Rectangular section 26 of chamber member 22 is shown abutting the upper and lower inside surfaces of receiving frame 10 so that it is guided thereby. Follower 30 is shown within slot 61 while follower 62 is shown within slot 14.

Figure 3:
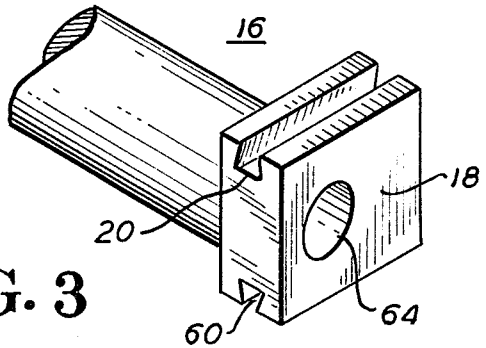
FIG. 3 is a perspective view of the barrel of FIG. 1.

Referring now to FIG. 3, barrel 16 (previously illustrated in FIGS. 1 and 2) is shown in perspective and broken at a relatively short distance from block 18. Its axial bore 64 is shown as an opening in block 18. It is appreciated that bore 64 continues through the entire length of barrel 16 to its muzzle. Previously illustrated grooves 60 and 20 are clearly shown in this figure.

Figure 4:
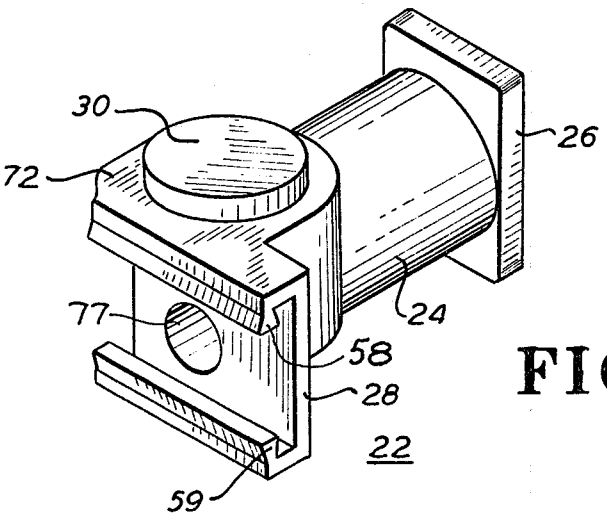
FIG. 4 is a perspective view of the chamber member of FIG. 1.

Referring to FIG. 4, a top perspective view of chamber member 22 is shown separately. Tongue 58 is shown as well as its opposing tongue 59. Tongues 58 and 59 are part of a channel-shaped section 28 having a "C" shaped cross-section. Emerging from section 28 is a transverse cylindrical portion 72 which has projecting therefrom follower 30. It is appreciated that there is opposing follower 30 on an opposite face of section 72 another follower (previously illustrated). Extending from cylindrical section 72 is cylindrical midsection 24 whose axis is orthogonal to that of cylindrical section 72. Rectangular section 26 forms an end of chamber member 22. As is apparent from earlier descriptions, chamber member 22 has a coaxial bore 77 for receiving propellant case 52 and a coaxial aperture in its rear section 26 for slidably mounting ejector rod 32.

Figure 5:
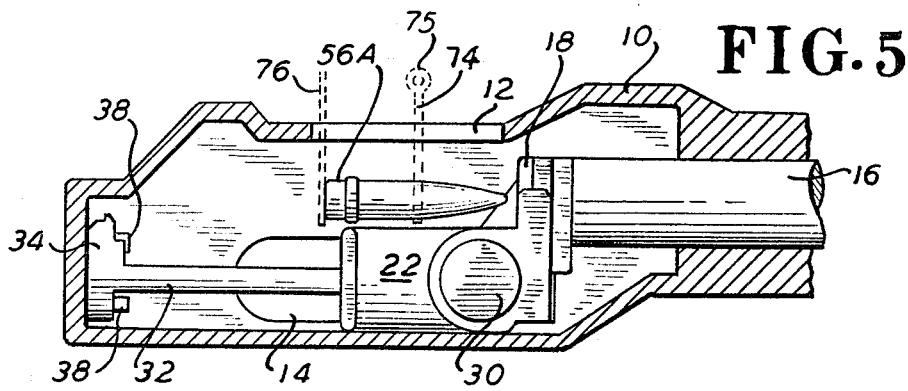
FIG. 5 is a plan view, partly in section, of the gun of FIG. 1 showing the chamber member displaced to an unlocked position.

Referring now to FIG. 5, barrel 16 and chamber member 22 are shown displaced from the positions previously shown. Chamber member 22 has been displaced from its previous position of alignment with barrel 16. In this position, herein referred to as the unlocked position, the previously described concavity in chamber member 22 is accessible and open. Also, barrel 16 in this position, referred to as a load position, has its axial bore (shown elsewhere) accessible through the breech end of block 18. Also, in this position ejector rod 32 and buffer 34 have been moved into abutment with the rear wall of frame 10. It is to be observed that buffer 34 is perforated to allow the passage therethrough of buffer means 38. In FIG. 5 a projectile 56A is shown aligned behind barrel 16. The positioning of projectile 56A may be performed by any conventional mechanical means. For example, projectile 56A may be thrust through projectile port 12 by means by a pair of spring steel tongs 74 (shown in phantom) which releasably engage projectile 56A but which may be thrust backwardly away therefrom by means of a pivot 75. Simultaneously moved into position with tongs 74 is a back up member 76 (shown in phantom) which prevents rearward translation of projectile 56A.

Figure 6:
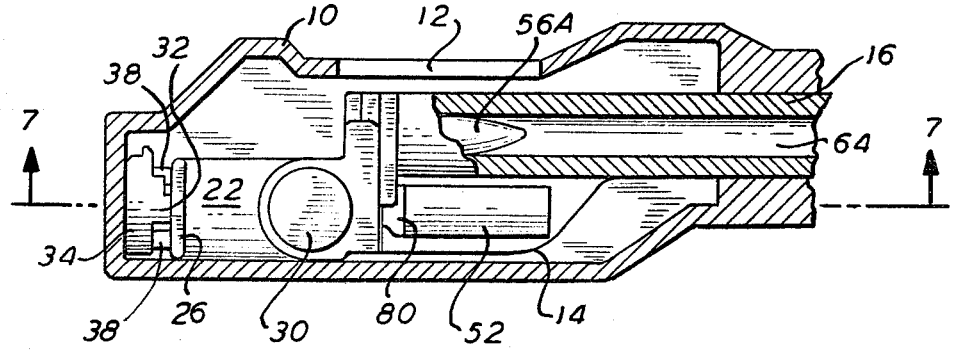
FIG. 6 is a plan view, partly in section, of the gun of FIG. 1 showing the barrel fully recoiled.

Referring to FIG. 6, barrel 16 and chamber member 22 are shown fully recoiled. In this position rod 32 has fully telescoped into chamber member 22. The forward end of rod 32, shaped into flared section 80, is shown protruding from the forward end of chamber member 22. Since rod 32 is contained within the axial concavity of chamber member 22, previously illustrated propellant case 52 can no longer reside therein. Accordingly, case 52 is shown in front of chamber member 22. Projectile 56A is shown already loaded into the axial bore 64 of barrel 16.

Figure 7:
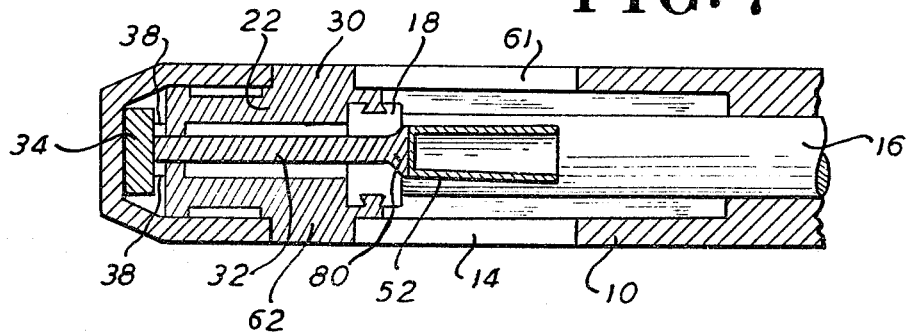
FIG. 7 is an elevational view, in section along lines 7—7 of FIG. 6.

Referring to FIG. 7, this sectional view along lines 7—7 of FIG. 6 shows case 52 empty of propellant and abutting the flared section 80 of rod 32. Also followers 62 and 30 are shown abutting the aft end of slots 14 and 61, respectively.

In order to more fully appreciate the foregoing apparatus its operation will be briefly described. Just prior to firing, barrel 16 and chamber member 22 are in the battery positions shown in FIGS. 1 and 2. Upon firing a shock wave from firing mechanism 36 propogates along rod 32 to ignite propellant 54 (FIG. 2). This ignition produces high pressure gas which bears upon the aft end of projectile 56, propelling it along the axial bore of barrel 16. Conservation of momentum requires that if projectile 56 is propelled forward, an opposing recoil motion ought to be created. Therefore, the combination of barrel 16 and chamber member 22 recoil backwards.

As a result, flange 44 (FIG. 1) translates backwardly compressing coil spring 46. For approximately the first one-half inch of recoil travel, followers 30 and 62 (FIGS. 1 and 2) travel in a linear path parallel to the axis of barrel 16. After travelling this initial subinterval, pressure within barrel 16 returns to nearly atmospheric conditions. Upon traversing transition section 30, chamber member 22 is displaced out of its alignment with barrel 16.

After followers 30 and 62 recoil through the path provided by transition section 30 and the corresponding transition section of slot 61, it is in the position shown in FIG. 5. In this condition the axial bore of barrel 16 is empty since the previously loaded projectile has been fired. In preparation for reloading tongs 74 and back-up member 76 move projectile 56A through projectile port 12 to the position shown in FIG. 5. So positioned projectile 56A can be ensheathed by barrel 16 as it further backwardly recoils. It is apparent that such backward translation of barrel 16 displaces tongs 74 by rotating them about their pivot 75. Projectile 56A is not translated backwards since member 76 prevents such movement. Accordingly, as barrel 16 fully recoils to the position shown in FIG. 6, the projectile 56A is loaded into bore 64 as shown. Simultaneously with the loading of projectile 56A, rod 32 telescopes into chamber member 22, ejecting spend projectile casing 52 (FIG. 6). Further recoil of the combination of barrel 16 and chamber member 22 is prevented by the collision between rectangular section 26 of chamber member 22 and buffer means 38.

In the condition illustrated in FIG. 6, spent case 52 may be ejected by downwardly thrusting it through slot 14 and replacing it with another propellant case. The next propellant case may be indexed downwardly through the slot opposing slot 14 (slot 61 of FIG. 7). The mechanism for ejecting a spent cartridge and replacing it with another is readily apparent to persons skilled in the art. By way of example, such a mechanism, after ejecting a spent cartridge, would hold a new propellant case in position in a fashion similar to that illustrated in connection with tongs 74 and member 76 of FIG. 5. Accordingly, when spent cartridge 52 (FIG. 6) is replaced by another case, the gun is now in a condition to counter-recoil in a manner described hereinafter.

As the combination of barrel 16 and chamber member 22 counter-recoil they return to the position shown in FIG. 5. It is apparent that during counter-recoil tongs 74 and member 76 will be withdrawn from frame 10. In moving from the position shown in FIG. 6 to that of FIG. 5 chamber member 22 ensheaths the new propellant case which has been positioned in the manner just described. Accordingly, during counter-recoil when barrel 16 and chamber member 22 are positioned as shown in FIG. 5, a projectile will have been loaded into barrel 16 and a propellant case into chamber member 22. As counter-recoil proceeds, followers 30 and 62 (FIGS. 2 and 1) will traverse their transition sections, such as section 30 of FIG. 1. Accordingly, chamber member 22 will be realigned and locked with barrel 16. This completes the cycle and returns the apparatus to the position initially described except that fresh ammunition has been loaded therein. It should be observed that in recoiling, barrel 16 need only travel the distance required to fully ensheath a projectile or a propellant case, not their combined length.

It is appreciated that the dimensions and shapes of the foregoing components may be varied to suit the specific requirements of individual embodiments. Such variations may be invoked to provide a desired range, muzzle velocity, repetition rate, accuracy, weight, strength, etc. Obviously many other modifications and variations of the present invention are possible in light of the above teachings. It is therefore to be understood that within the scope of the appended claims, the invention may be practiced otherwise than as specifically described.

What is claimed is:

1. An automatic gun for firing a projectile by means of a separately loaded propellant case comprising:

a receiving frame;

an elongated barrel having a breech end transpierced by an axial bore, said barrel being mounted in said frame for reciprocation therein;

resilient means for forwardly urging said barrel to a battery position; and a chamber member having a concavity shaped to hold said propellant case, said chamber member being slidably mounted on said breech end of said barrel, said chamber member being transversely displaceable from alignment with said axial bore to an unlocked position at which said concavity is accessible, said receiving frame including:

actuating means for transversely displacing said chamber member from alignment with said axial bore to said unlocked position in response to said barrel recoiling;

wherein said actuating means commences transverse displacement of said chamber member after said barrel recoils through an initial subinterval, and wherein said actuating means transversely displaces said chamber member to said unlocked position prior to the arrival of said barrel at a load position, said projectile being coaxially positionable behind said breech end so that further recoil from said load position causes said barrel to ensheath said projectile.

2. An automatic gun according to claim 1 wherein said actuating means synchronously reciprocates said chamber member with respect to said barrel in response to reciprocation of said barrel in said receiving frame, said chamber member being displaced to and maintained at said unlocked position until said barrel returns to within a predetermined distance of said battery position, at the cessation of recoil said propellant case being coaxially positionable in front of said concavity so that return of said barrel to within said predetermined distance from said battery position causes said chamber member to ensheath said propellant case.

3. An automatic gun according to claim 2 wherein said chamber member has transpiercing its aft face and communicating with its concavity a coaxial aperture, said gun further comprising:

an ejector rod slidably mounted in said aperture, said rod being sized to engage said frame during recoil of said barrel and telescope into said chamber member, whereby said ejector rod is operable to eject said propellant case.

4. An automatic gun according to claim 3 wherein said receiving frame has a nonlinear track, said chamber member having a follower projecting therefrom into said track.

5. An automatic gun according to claim 4 wherein said frame includes a buffer means for engaging said chamber member and smoothly stopping it and said barrel during recoil.

6. An automatic gun according to claim 5 wherein said chamber member and said barrel are joined by a horizontally aligned tongue and groove.

7. An automatic gun according to claim 6 wherein said frame has a projectile port sized to allow insertion of said projectile and located adjacent to said breech end when said barrel is at said load position.

8. An automatic gun according to claim 3 wherein said receiving frame includes:

a pair of opposing walls transpierced by nonlinear symmetrical slots, said chamber member having a pair of opposing followers each projecting into a corresponding one of said slots, said slots being sized and positioned to allow insertion and ejection of said propellant case through said slots.

9. An automatic gun according to claim 3 wherein said ejector rod includes:

trigger means for firing said propellant case when said barrel is in its battery position.

* * * * *